US012637925B2

(12) United States Patent
Lopez et al.

(10) Patent No.: US 12,637,925 B2
(45) Date of Patent: May 26, 2026

(54) METHOD FOR OPERATING AN INSTALLATION FOR THE GEOLOGICAL SEQUESTRATION OF CARBON DIOXIDE IN AN AQUIFER RESERVOIR

(71) Applicant: TECHNIP ENERGIES FRANCE, Nanterre Cedex (FR)

(72) Inventors: Audrey Lopez, Nanterre Cedex (FR); Luc Heme De Lacotte, Nanterre Cedex (FR); Geoffrey Guindeuil, Nanterre Cedex (FR); Stéphanie Harchambois, Nanterre Cedex (FR); Hayder Al Jawdah, Nanterre Cedex (FR); Morvan Favennec, Nanterre Cedex (FR)

(73) Assignee: TECHNIP ENERGIES FRANCE, Nanterre (FR)

( * ) Notice: Subject to any disclaimer, the term of this patent is extended or adjusted under 35 U.S.C. 154(b) by 0 days.

(21) Appl. No.: 18/856,399

(22) PCT Filed: Apr. 14, 2023

(86) PCT No.: PCT/EP2023/059796
§ 371 (c)(1),
(2) Date: Oct. 11, 2024

(87) PCT Pub. No.: WO2023/198895
PCT Pub. Date: Oct. 19, 2023

(65) Prior Publication Data

US 2025/0257633 A1 Aug. 14, 2025

(30) Foreign Application Priority Data

Apr. 14, 2022 (FR) ..... 2203482

(51) Int. Cl.
*E21B 41/00* (2006.01)

(52) U.S. Cl.
CPC ..... *E21B 41/0064* (2013.01)

(58) Field of Classification Search
CPC ..... E21B 41/0064
See application file for complete search history.

(56) References Cited

U.S. PATENT DOCUMENTS

2012/0038174 A1* 2/2012 Bryant ..... H02K 7/18 165/45
2014/0116358 A1* 5/2014 Stallmann ..... F01N 3/2066 122/23

(Continued)

FOREIGN PATENT DOCUMENTS

EP 1571105 A2 9/2005
FR 3125011 A1 1/2023

OTHER PUBLICATIONS

Klapperich R.J. et al. "IEAGHG Investigation of Extraction of Formation Water from CO2 Storage", NL, vol. 37, Jan. 1, 2013 (Jan. 1, 2013), pp. 2479-2486, Energy Procedia, Retrieved from the Internet: http://dx.doi.org/10.1016/j .egypro.2013.06.129 [retrieved on Nov. 30, 2022] DOI: 10.1016/j.egypro.2013.06.129 ISSN: 1876-6102, XP093003718 cited in the application the whole document.

*Primary Examiner* — Silvana C Runyan
(74) *Attorney, Agent, or Firm* — Kilpatrick Townsend & Stockton LLP

(57) ABSTRACT

An installation for the geological sequestration of carbon dioxide can include a structure and a device for injecting a flow of carbon dioxide into a geological reservoir. The injection device can include an injection pipe and a device for extracting a flow of water from the geological reservoir. The extraction device can include an extraction pipe. The installation further can include a heat exchanger that can be connected to the injection and extraction pipes. Operating the installation can include injecting the flow of carbon dioxide into the reservoir, simultaneously extracting the flow (Continued)

Figure 1:
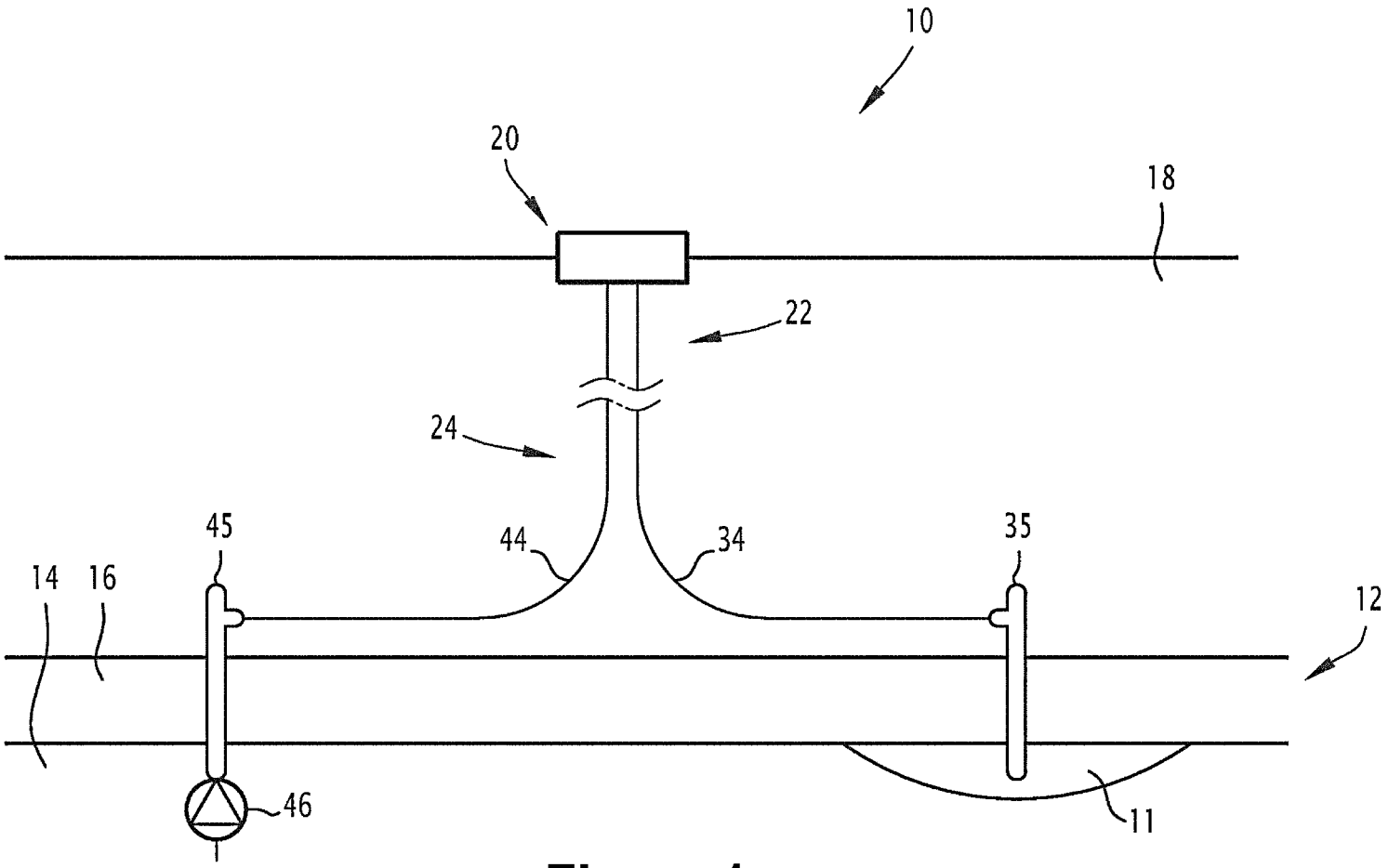

of water from the reservoir, and bringing the flows of carbon dioxide and of water into thermal contact in the exchanger.

13 Claims, 2 Drawing Sheets

(56) References Cited

U.S. PATENT DOCUMENTS

| | | | | |
|---|---|---|---|---|
| 2015/0345279 | A1* | 12/2015 | Bryant | C10L 3/06 585/800 |
| 2017/0283014 | A1 | 10/2017 | Baker | |
| 2018/0171768 | A1* | 6/2018 | Tiffany, III | C02F 9/00 |

* cited by examiner

METHOD FOR OPERATING AN INSTALLATION FOR THE GEOLOGICAL SEQUESTRATION OF CARBON DIOXIDE IN AN AQUIFER RESERVOIR

The present invention relates to a method for operating an installation for the geological sequestration of carbon dioxide, said installation comprising: a structure, preferably floating; an injection device, suitable for injecting a flow of carbon dioxide into a geological reservoir from the structure, said injection device comprising an injection pipe intended to receive said flow of carbon dioxide upstream of the geological reservoir; and an extraction device, suitable for extracting a flow of water from said geological reservoir, said extraction device comprising an extraction pipe intended to receive said flow of liquid water downstream of the geological reservoir.

The invention is particularly applicable to off-shore installations, as described in US2017/0283014, or in the as yet unpublished application FR2107559 to the Applicant. These installations are designed to inject carbon dioxide ($CO_2$) into geological reservoirs, particularly underwater ones, for sequestration purposes.

Carbon dioxide sequestration aims to reduce greenhouse gas emissions into the atmosphere. In particular, carbon dioxide has been known to be injected into aquifer reservoirs, that is sites with an underground water supply. The paper "*IEAGHG Investigation of Extraction of Formation Water from $CO_2$ Storage*", *Energy Procedia* 37 (2013) 2479-2486, illustrates the benefits of extracting water from the reservoir simultaneously with carbon dioxide injection. These advantages include a reduction in pressure inside the reservoir, which facilitates carbon dioxide injection.

Before injection, it is common practice to store carbon dioxide in liquid form, at temperatures below −20° C. Such temperatures are too low for injection, as they entail the risk of hydrate formation in the reservoir's diffusion channels, and/or blockage of said channels. Before injection, it is best to raise the temperature of the carbon dioxide, for example to between 0° C. and 5° C.

Furthermore, the water extracted from aquifer reservoirs is often at a high temperature, for example between 50° C. and 65° C. The extracted water is discharged into the sea, for example. To comply with environmental standards, water must be treated before being discharged, in particular by lowering its temperature.

The purpose of the present invention is to provide an improved method for injecting carbon dioxide into an aquifer reservoir with simultaneous extraction of water from said reservoir.

To this end, the invention has as its object an operating method of the aforesaid type, wherein: the installation further comprises a heat exchanger, which is connected to the injection and extraction pipes; and the method comprises the following steps: injecting the flow of carbon dioxide into the reservoir, simultaneously extracting the flow of water from said geological reservoir; and bringing the flow of carbon dioxide upstream of the geological reservoir into thermal contact, within the heat exchanger, with the flow of water extracted from said geological reservoir.

According to other advantageous aspects of the invention, the operating method comprises one or more of the following features, taken individually or in any technically possible combination:

- the structure comprises a compartment for storing carbon dioxide in a liquid state; and the flow of carbon dioxide into the geological reservoir is injected from said storage compartment;
- carbon dioxide is injected continuously into the geological reservoir;
- when the flow of carbon dioxide is brought into thermal contact with the extracted flow of water, said flows circulate in counter-current in the heat exchanger;
- when the flow of carbon dioxide is brought into thermal contact with the extracted flow of water, each of said flows is in the liquid phase.

The invention further relates to an installation for the geological sequestration of carbon dioxide, said installation comprising: a structure, preferably floating; an injection device, suitable for injecting a flow of carbon dioxide into a geological reservoir from the structure, said injection device comprising an injection pipe intended to receive said flow of carbon dioxide upstream of the geological reservoir; and an extraction device, suitable for extracting a flow of water from said geological reservoir, said extraction device comprising an extraction pipe intended to receive said flow of liquid water downstream of the geological reservoir; and a heat exchanger connected to the structure and fitted to the injection pipe and extraction pipe; the installation being equipped with means for implementing the method described above.

An advantageous aspect of the invention is that the heat exchanger is a liquid/liquid exchanger.

Figure 2:
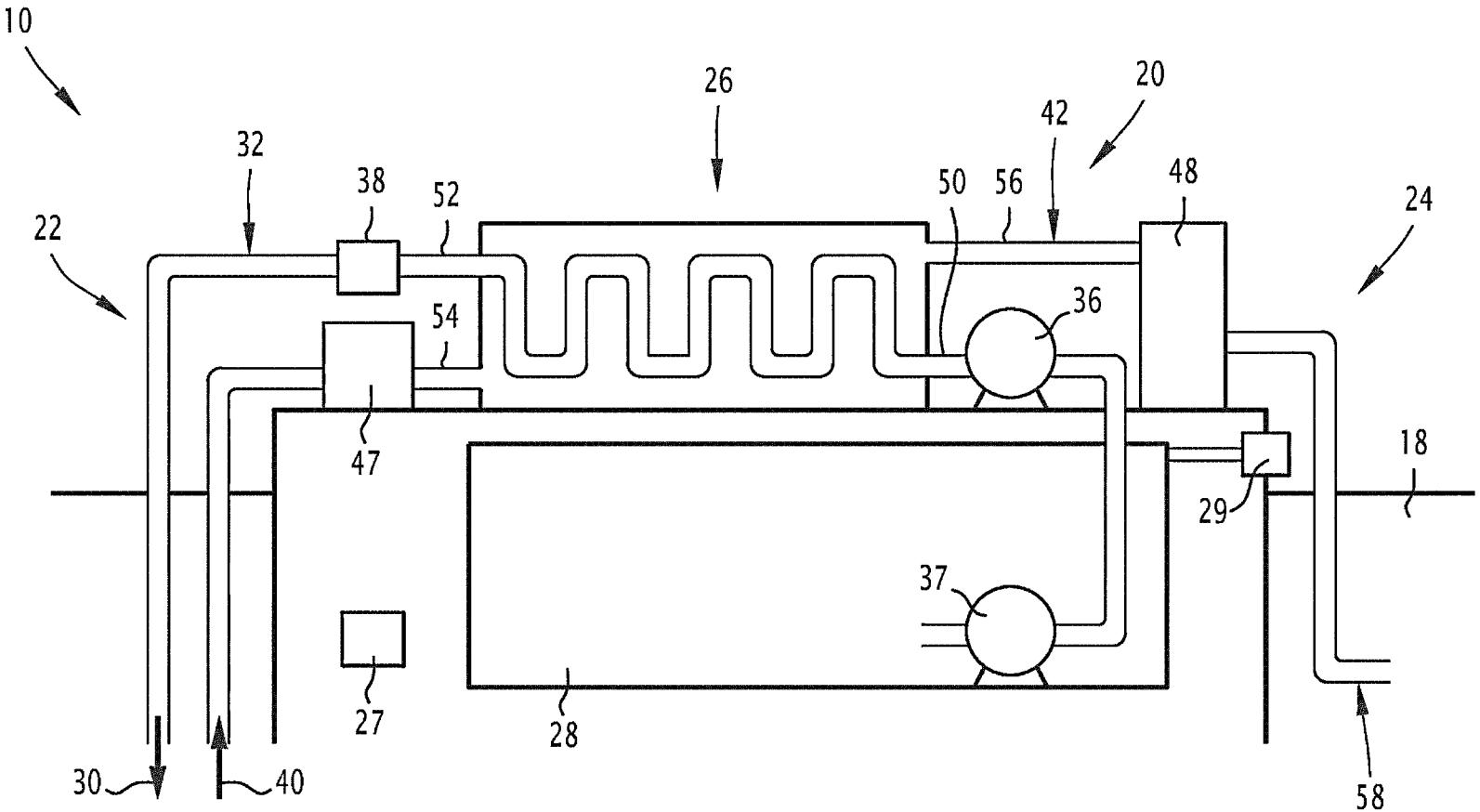

The invention will be better understood upon reading the following disclosure, given solely by way of non-limiting example, and done with reference to the drawings, wherein:

FIG. 1 is a schematic representation of an installation for the geological sequestration of carbon dioxide, according to one embodiment of the invention; and FIG. 2 is a detailed view of the installation of FIG. 1.

FIG. 1 shows an installation 10 for the injection and geological sequestration of carbon dioxide, according to one embodiment of the invention. The installation 10 is suitable for receiving and injecting carbon dioxide 11 into a geological reservoir 12.

The geological reservoir 12 is an aquifer reservoir, that is it comprises a reserve 14 of water held under solid ground 16.

In the embodiment shown, the geological reservoir 12 is also a submarine reservoir. "Submarine" means that the ground 16 is covered by the sea 18 or, alternatively, by a body of fresh water such as a lake.

The installation 10 comprises a structure 20, an injection device 22, a water extraction device 24 and a heat exchanger 26. Said heat exchanger 26 can be seen in FIG. 2 showing a detailed view of the structure 20.

The system 10 further comprises an electronic control module 27.

In the case of a submarine geological reservoir 12, the structure 20 is preferably floating, as in the embodiment shown. Structure 20 is, for example, a Single Point Anchor Reservoir (SPAR), or a semi-submersible platform, or an Offshore C-Hub™ ship hull.

In the embodiment shown in FIG. 2, the structure 20 further comprises a compartment 28 for storing carbon dioxide in a liquid state.

Preferably, the structure 20 further comprises a device 29 for connecting and discharging liquid carbon dioxide into the compartment 28. Preferably, the structure 20 further comprises an energy-generating and/or energy-storing member (not shown), as described in the aforementioned FR2107559 application.

The injection device 22 is able to inject a flow 30 (FIG. 2) of carbon dioxide into the geological reservoir 12 from the structure 20. In particular, the injection device 22 is able to: withdraw carbon dioxide in a liquid state from the storage compartment 28; condition said carbon dioxide to a desired state; and send said conditioned carbon dioxide into the geological reservoir 12.

In the embodiment shown, the injection device 22 particularly comprises an injection pipe 32.

The injection pipe 32 is intended to receive the flow 30 upstream of the geological reservoir 12. In the present description, the terms "upstream" and "downstream" refer to the direction of flow through the pipe.

In the embodiment shown, the injection pipe 32 comprises a long, submerged first pipe 34, located beneath the structure 20 (FIG. 1). Preferably, said first pipe 34 is flexible. Upstream of the first pipe 34, the injection pipe 32 is formed by conduits integral with the structure 20.

In the embodiment shown, the injection device 22 further comprises a first well 35, an injection pump 36, a lift pump 37 and a conditioning unit 38.

The first well 35 (FIG. 1) is connected to the first pipe 34 and attached to the seabed 16. The term "well" means a device formed by a wellhead, which protrudes from the ground 16, and one or more rigid pipes, for example made of steel, which connect said wellhead to the reserve 14.

The injection pump 36, lift pump 37, and conditioning unit 38 will be described later.

The water extraction device 24 is able to extract a flow 40 (FIG. 2) of liquid water from the geological reservoir 12. In the embodiment shown, the extraction device particularly comprises an extraction pipe 42.

The extraction pipe 42 is designed to receive the flow 40 of liquid water downstream of the geological reservoir 12. In the embodiment shown, the extraction pipe 42 comprises a long, submerged second pipe 44, located beneath the structure 20. Preferably, said second pipe 44 is flexible. Upstream of said second pipe 44, the extraction pipe 42 is formed by conduits integral with the structure 20.

In the embodiment shown, the water extraction device 24 further comprises a second well 45, an extraction pump 46, a grit removal unit 47 and a treatment unit 48.

The second well 45 (FIG. 1) is connected to the second pipe 44 and attached to the seabed 16. As mentioned above for the first well 35, the second well 45 comprises a wellhead, which protrudes from said ground 16, and at least one pipe which connects said wellhead to the reserve 14.

The extraction pump 46 is connected to the second well 45 and is preferably located at the bottom of the well, in the reserve 14. The grit removal and treatment units 46 and 48 will be described later.

The heat exchanger 26 is arranged on both the injection pipe 32 and the extraction pipe 42 and is thus able to bring the flow of carbon dioxide 30 and the extracted flow of water 40 into thermal contact.

In particular, the heat exchanger comprises: a first inlet 50 and a first outlet 52 for the injection pipe 32; and a second inlet 54 and a second outlet 56 for the extraction pipe 42.

Preferably, the heat exchanger, the injection pipe 32 and extraction pipe 42 are configured so that the flows 30 and 40 circulate in counter-current inside said exchanger.

The heat exchanger 26 is preferably a liquid/liquid exchanger, as in the embodiment shown. In FIG. 2, the heat exchanger 26 is shown schematically as a serpentine exchanger, but other types of liquid/liquid exchangers can be used. For example, a heat exchanger with an intermediate heat transfer liquid can be used.

In the embodiment shown, the heat exchanger 26 is arranged on the structure 20.

The injection pump 36 of the injection device 22 is arranged on the injection pipe 32, between the storage compartment 28 and the heat exchanger 26.

The lift pump 37 of the injection device 22 is also arranged on the injection pipe 32, at the bottom of the storage compartment 28.

The conditioning unit 38 of the injection device 22 is arranged on the injection pipe 32 downstream of the heat exchanger 26. The optional conditioning unit 38 comprises means for conditioning the flow of carbon dioxide 30 to a desired state for lowering into the first pipe 34. For example, the conditioning unit 38 comprises additional heating means in case the temperature of the flow 30 leaving the heat exchanger 26 is still too low.

The grit removal unit 47 and the treatment unit 48 are located on the extraction pipe 42, respectively upstream and downstream of the heat exchanger 26. The treatment unit 48 is configured, for example, to purify the flow of water 40 of heavy metal or salt compounds in high concentration.

In the embodiment shown, downstream of the treatment unit 48, the extraction pipe 42 has an outlet 58 leading into the sea 18. Alternatively, the installation 10 can be configured to use the flow of water 40 in a different way, for example to produce drinking water.

A method for operating the installation 10 will now be described.

This method is controlled by the electronic control module 27, in particular by means of the injection pump 36, the lift pump 37 and the extraction pump 45.

In particular, said method comprises the following steps: generating a flow 30 of carbon dioxide in the injection pipe 32, for injection into the geological reservoir 12; in parallel, generating a flow 40 for extracting water from said geological reservoir 12; and bringing said flows 30 and 40 into thermal contact in the heat exchanger 26.

For example, the lift pump 37 and injection pump 36 transfer a flow 30 of liquid carbon dioxide, previously stored in the storage compartment 28, to heat exchanger 26. Given the storage conditions, at the first inlet 50 of the heat exchanger 26, the liquid carbon dioxide is, for example, at a high inlet pressure, of the order of 100 bar, and at an inlet temperature below −20° C., for example between −50° C. and −45° C.

At the same time, the extraction pump 46 generates, at the second well 45, a flow 40 of water extracted from the reserve 14 of the geological reservoir 12. In the structure 20, said flow 40 first has its grit removed by the grit removal unit 47 before arriving at the second inlet 54 of the heat exchanger 26. At said second inlet 54, the flow 40 is liquid, for example at an inlet pressure of around 5 to 6 bar and an inlet temperature of between 60° C. and 70° C.

The liquid flows 30 and 40 circulate in counter-current through the heat exchanger 26, and the flow of water 40 transfers heat to the flow 30 of carbon dioxide. At the first outlet 52 of the heat exchanger 26, the liquid flow of carbon dioxide 30 is, for example, at an outlet pressure close to the inlet pressure, with a deviation of 0 to 5 bar; and at an outlet temperature higher than the inlet temperature.

The outlet temperature of the flow 30 is preferably in the range 0° C. to 5° C., which is a suitable temperature for injecting liquid carbon dioxide into geological reservoir 12.

At the second outlet 56 of the heat exchanger 26, the liquid flow of water 40 is, for example, at an outlet pressure close to the inlet pressure, with a deviation of 0 to 2 bar, and at an outlet temperature lower than the inlet temperature.

The outlet temperature of the flow 40 is, for example, in the range of 40° C. to 45° C., a temperature suitable for discharge into the sea.

The installation 10 thus enables appropriate thermal treatment of both the carbon dioxide to be injected and the water extracted from the same geological reservoir. The installation 10 therefore eliminates the need for additional heating and cooling devices.

However, downstream of the heat exchanger 26, the flow of carbon dioxide 30 is optionally reheated by conditioning unit 38, if the outlet temperature is insufficient.

Downstream of said conditioning unit 38, said flow 30, preferably in a liquid state, reaches the first pipe 34 and is then injected into the geological reservoir 12 at well 35.

Extracting the flow of water 40 at the same time as injecting the carbon dioxide facilitates said injection by lowering the pressure in the geological reservoir 12.

Downstream of the heat exchanger 26, the flow of water 40 is treated by treatment unit 48, which removes pollutant compounds such as mercury from the water. The flow of water 40 is finally discharged into the sea 18 through the outlet 58.

Preferably, the injection device 22 performs a continuous injection of carbon dioxide into the geological reservoir 12, in particular from the storage compartment 28. "Continuous injection" means that the injection flow rate from injection device 22 to the geological reservoir 12 is always strictly greater than zero. Continuous injection reduces the risk of hydrate formation in the geological reservoir's diffusion channels.

When the carbon dioxide level in compartment 28 is low, the compartment 28 is fed by means of connection and discharge device 29. A liquid carbon dioxide transport vessel, for example, is coupled to the device 29 to fill the compartment 28.

The invention claimed is:

1. A method for operating an installation for a geological sequestration of carbon dioxide, said installation comprising:

a structure;

an injection device, suitable for injecting a flow of carbon dioxide into a geological reservoir from the structure, said injection device comprising an injection pipe for receiving said flow of carbon dioxide upstream of the geological reservoir; and an extraction device suitable for extracting a flow of water from said geological reservoir, said extraction device comprising an extraction pipe for receiving said flow of water downstream of the geological reservoir;

wherein:

the installation further comprises a heat exchanger connected to the structure, to the injection pipe, and to the extraction pipe, the heat exchanger comprising a first inlet and a first outlet for the injection pipe and a second inlet and a second outlet for the extraction pipe; and the method comprises the following steps: injecting the flow of carbon dioxide into the geological reservoir from the structure; simultaneously extracting of the flow of water from said geological reservoir; and bringing the flow of carbon dioxide upstream of the geological reservoir into thermal contact, within the heat exchanger, with the flow of water extracted from said geological reservoir.

2. The method according to claim 1, wherein: the structure comprises a storage compartment for storing carbon dioxide in a liquid state; and the flow of carbon dioxide into the geological reservoir is injected from said storage compartment.

3. The method according to claim 1, wherein the injection device further comprises a conditioning unit arranged on the injection pipe downstream of the heat exchanger to condition the flow of carbon dioxide to a desired state.

4. The method according to claim 1, wherein when the flow of carbon dioxide is brought into thermal contact with the extracted flow of water, said flows circulate in countercurrent in the heat exchanger.

5. The method according to claim 1, wherein when the flow of carbon dioxide is brought into thermal contact with the extracted flow of water, each of said flows is in a liquid phase.

6. The method according to claim 1, wherein the structure is a floating structure.

7. The method according to claim 1, wherein the injection device comprises a first well connected to a first pipe of the injection pipe, and wherein the extraction device comprises a second well connected to a second pipe of the extraction pipe.

8. The method according to claim 1, further comprising:

generating the flow of carbon dioxide in the injection pipe for injection into the geological reservoir, wherein generating the flow of carbon dioxide in the injection pipe occurs in parallel with extracting the flow of water from the geological reservoir.

9. An installation for a geological sequestration of carbon dioxide, said installation comprising:

a structure;

an injection device, suitable for injecting a flow of carbon dioxide into a geological reservoir from the structure, said injection device comprising an injection pipe for receiving said flow of carbon dioxide upstream of the geological reservoir;

an extraction device suitable for extracting a flow of water from said geological reservoir, said extraction device comprising an extraction pipe for receiving said flow of water downstream of the geological reservoir; and a heat exchanger connected to the structure, to the injection pipe, and to the extraction pipe, the heat exchanger comprising a first inlet and a first outlet for the injection pipe and a second inlet and a second outlet for the extraction pipe, the installation being equipped to:

inject the flow of carbon dioxide into the geological reservoir from the structure;

simultaneously extract the flow of water from the geological reservoir; and bring the flow of carbon dioxide upstream of the geological reservoir into thermal contact, within the heat exchanger, with the flow of water extracted from the geological reservoir.

10. The installation according to claim 9, wherein the heat exchanger is a liquid/liquid exchanger.

11. The installation according to claim 9, wherein the structure is a floating structure.

12. The installation according to claim 9, wherein the injection device comprises a first well connected to a first pipe of the injection pipe, and wherein the extraction device comprises a second well connected to a second pipe of the extraction pipe.

13. The installation according to claim 9, wherein the installation is further equipped to:

generate the flow of carbon dioxide in the injection pipe for injection into the geological reservoir, wherein generating the flow of carbon dioxide in the injection pipe occurs in parallel with extracting the flow of water from the geological reservoir.

* * * * *